United States Patent [19]

Shapero

[11] Patent Number: 4,932,919

[45] Date of Patent: Jun. 12, 1990

[54] POSABLE FIGURE WITH CONTINUOUS SKIN

[75] Inventor: Wallace H. Shapero, West Hills, Calif.

[73] Assignee: Mattel, Inc., Hawthorne, Calif.

[21] Appl. No.: 322,031

[22] Filed: Mar. 13, 1989

[51] Int. Cl.[5] ..... A63H 3/04

[52] U.S. Cl. ..... 446/374; 446/370

[58] Field of Search ..... 446/374, 370, 373, 375, 446/371, 385

[56] References Cited

U.S. PATENT DOCUMENTS

| | | | |
|---|---|---|---|
| 1,446,466 | 2/1923 | Huth | 446/374 |
| 1,595,203 | 8/1926 | Leathers . | |
| 2,129,421 | 9/1938 | Hales . | |
| 3,284,947 | 11/1966 | Dahl . | |
| 3,325,939 | 6/1967 | Ryan et al. | 446/374 |
| 3,357,610 | 12/1967 | Quinby, Jr. . | |
| 3,394,490 | 7/1968 | Baxter . | |
| 3,395,484 | 8/1968 | Smith . | |
| 3,624,691 | 11/1971 | Robson et al. . | |
| 3,807,086 | 4/1974 | Scheich . | |
| 4,571,209 | 2/1986 | Manning et al. . | |

*Primary Examiner*—Mickey Yu

*Attorney, Agent, or Firm*—Roy A. Ekstrand

[57] ABSTRACT

A posable figure includes a one-piece integrally molded armature defining a plurality of integrally molded joint members which provide articulation of the elements of the armature. A one-piece molded skin, preferably formed of a plastic or rubber material, is molded about the armature as a single unitary covering completely enclosing the armature with the exception of the hand and foot portions thereof. The various molded joints of the armature are structured to provide the desired limitations on articulation to duplicate a human figure.

15 Claims, 2 Drawing Sheets

POSABLE FIGURE WITH CONTINUOUS SKIN

FIELD OF THE INVENTION

This invention relates generally to posable figures and particularly to those utilizing an elastic molded outer skin.

BACKGROUND OF THE INVENTION

Through the years a number of different figures such as dolls or miniature animals or the like have been constructed to provide amusement devices and display figures. Among the many types of figures created are those generally described as posable figures. In most posable figures, a movable articulated body and limb combination is provided with the object of producing a structure which is posable and therefore may be manipulated into a variety of positions or poses. Ideally, such posable figures have little or no tendency to return to their previous position but rather remain in the position to which the limbs and body have been posed. In figures intended to represent humans or fanciful creatures similar to humans, there is an additional desire to provide an outer covering which approximates the look and feel of a flesh covered skeleton.

These needs have prompted practitioners in the art to devise a great variety of structures and methods of manufacture. One such structure is set forth in U.S. Pat. No. 1,595,203 issued to Leathers which sets forth a TOY AND THE MANUFACTURE THEREOF in which an articulated frame member is provided with a plurality of friction joint elements to approximate a human skeletal structure. A molded resilient covering is molded about the frame and the resulting composite is dipped in a rubber solution to provide a thin outer skin covering.

U.S. Pat. No. 2,129,421 issued to Hales sets forth a MANNEQUIN AND METHOD OF MAKING THE SAME in which a multiply-articulated skeletal frame includes a plurality of skeletal elements interconnected by a plurality of spring loaded ball and socket joints. A rubber covering is molded about the multiply-articulated skeletal frame to produce the outer appearance and feel of a human figure.

U.S. Pat. No. 3,284,947 issued to Dahl sets forth an ADJUSTABLE DOLL HAVING DEGASSED MALLEABLE CORE having a multiple element skeleton including a supporting framework having a plurality of substantially rigid portions interconnected by relatively deformable joint means. The joint simulating means include a deformable portion of low strength material adapted to be easily bent or twisted. Means are provided for restricting the degree of movement by certain selected ones of the joints to simulate the degree of movement possible in the human figure or the like. An outer molded covering of resilient material is molded upon the skeletal members to complete the figure.

U.S. Pat. No. 3,357,610 issued to Quinby, Jr. sets forth a HUMAN APPEARING MANIKAN AND METHOD OF MAKING having a supporting skeleton formed of a plurality of tubular elements interconnected by a plurality of articulated joints. An outer covering of resilient material is formed in two body halves which are cemented together to enclose the skeleton and complete the figure construction.

U S. Pat. No. 3,807,086 issued to Schleich sets forth a BENDING FIGURE formed of flexible thermoplastic material an fabricated in two molded parts. One of the molded parts supports a metal frame while the other is configured to receive the extending portion of the metal frame when the two halves are brought together and bonded to complete the figure. The frame is preferably formed of a malleable material to permit posing of the figure.

U.S. Pat. No. 3,394,490 issued to Baxter sets forth a JOINTED LIMB AND METHOD FOR MANUFACTURING THE SAME in which a limb, such as a human leg, includes a joint member for coupling to the hip portion of a human figure and further includes a multiply-articulated skeletal member upon which a resilient outer flesh duplicating covering is molded.

U.S. Pat. No. 3,395,484 issued to Smith sets forth DOLL FIGURES HAVING AN INTERNAL WIRE SKELETON in which a plurality of malleable wire elements are configured to approximate the skeleton of a figure such as a human or the like. Material is wrapped about the skeletal wire to provide a better bond between the skeletal member and the outer covering of molded plastic or sponge rubber which completes the figure.

U.S. Pat. No. 3,624,691 issued to Robson, et al. sets forth a REALISTIC TOY FIGURE having an armature which includes bendable wires and flesh colored molded plastic hand and foot areas. The armature is covered with a soft plastic foam or the like to represent the human form in all regions except the hands and feet. The armature includes bracing portions molded over certain parts of the wire forming the skeletal armature to provide rigid areas and restrict movement to the desired bending portions of the armature.

U.S. Pat. No. 4,571,209 to Manning, et al. sets forth an ARTICULATED TOY FIGURE which is formed in a pair of molding operations such that certain frame elements are molded during the first molding process while the remaining frame members are molded during thee second molding process without removal of the initially formed elements. The resulting structure comprises a multiply-articulated frame having rigid elements secured by movable joints. Upon the completion of the second molding process, the joints are secured by a plurality of breakable elements which, once flexed, permit the motion of the joint elements and result in an articulated frame.

While some success has been achieved by the prior art structures such as those set forth above in obtaining a posable multiply-articulated figure, the resulting structures are often expensive, difficult to fabricate while complicating the molding process, and tend to be less than truly posable. In addition, the prior art structures have been found to be subject to early failure of the joint elements and often fail to be articulated in a realistic manner. The latter results in a poor rendition of the intended doll, animal figure, or the like. There remains, therefore, a need in the art for a posable figure which provides realistic movement of a plurality of articulated limbs and body while supporting a continuous skin having a resilience and character which closely approximates the flesh of the intended object. There remains a further need in the art for a posable figure having continuous skin which may be easily and inexpensively fabricated in a molding process.

SUMMARY OF THE INVENTION

Accordingly, it is general object of the present invention to provide an improved posable figure. It is a more particular object of the present invention to provide an improved posable figure having realistic articulation and truly posable movement. It is a still more particular object of the present invention to provide an improved posable figure having extended life and resistance to failure of the articulated joint members.

In accordance with the invention, there is provided a molded one-piece armature having a plurality of skeletal elements coupled by a plurality of integrally molded posable joint members which may be insert molded into a continuous flesh and skin outer covering to produce a posable figure having a continuous outer skin.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
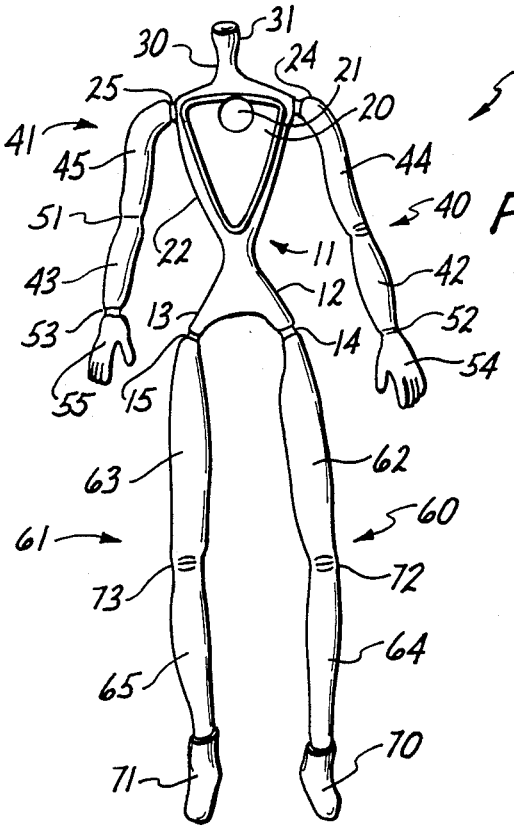
FIG. 1 is a front view of a one-piece armature constructed in accordance with the present invention.

FIG. 1 sets forth a front view of the molded armature portion of the present invention posable figure generally referenced by numeral 10. At the outset, it should be noted that armature 10 in accordance with an important aspect of the present invention, is formed of a single unitary molded member having no separate parts or elements assembled thereto. Armature 10 includes a trunk support 11 which defines a generally triangular cavity 20 and an aperture 21 extending therethrough. Trunk 11 further defines a pair of downwardly extending hip supports 12 and 13 and an upwardly extending neck support 30 which terminates in a head support 31. A left arm support 40 includes an upper arm support 44 coupled to trunk support 11 by a shoulder joint 24, a forearm support 42 coupled to upper arm support 44 by an elbow joint 50, and a left hand 54 coupled to forearm support 42 by a wrist joint 52. Similarly, a right arm support 11 includes an upper arm support 45 coupled to trunk support 11 by a shoulder joint 25, a forearm support 43 coupled to upper arm support 45 by an elbow joint 51, and a right hand 55 coupled to forearm support 48 by a wrist joint 53.

A left leg support 60 includes a thigh support 62 coupled to hip support 12 by a hip joint 14, a shin support 64 coupled to thigh support 62 by a knee joint 72, and a left foot 70 attached to shin support 64. Similarly, a right leg support 61 includes a thigh support 63 coupled to hip support 13 by a hip joint 15, a shin support 65 coupled to thigh support 68 by a knee joint 78, and a right foot 71 coupled directly to shin support 65.

As will be apparent, armature 10 is configured to generally represent a human or human-like figure and, in the case of the preferred embodiment, is constructed to represent a female human figure. It will be apparent to those skilled in the art, however, that the general dimensions and relative proportions of armature 10 may be substantially changed to produce a posable figure constructed in accordance with the present invention which corresponds to other human and human-like figures. For example, in the event a human male is to be fabricated in accordance with the present invention, it may be preferable to substantially increase the span between shoulder joints 24 and 25 thereby depicting a substantially more broad shouldered and more muscular figure than armature 10 as presently shown. By way of further example, a fanciful human-like figure or animal-like figure resembling a gorilla or ape, would require altering the relative proportions of armature 10 to substantially shorten leg supports 60 and 61 while lengthening arm supports 40 and 41 and making corresponding adjustments in the proportion of trunk support 11.

In any event, armature 10 is, as mentioned above, formed of a single unitary molded member in which shoulder joints 24 and 25, elbow joints 50 and 51, hip joints 14 and 15, and knee joints 72 and 73 are integrally formed and part of armature 10. While the structures of the various joints in armature 10 are described below in greater detail, it should be noted here that the joints of armature 10 generally comprise sharply narrowed portions of the armature material which form hinge-like connections between the various armature support elements. While armature 10 may be fabricated of any thermol plastic material which yields with little force and has little tendency of returning to its initial configuration due to its elasticity, particular success has been achieved using polybutylene terephthalate, polyethylene terephthalate, copolyester and copolyester glycol modified polyethylene terephthalate. It has been found that the foregoing materials may, in addition, be melt-blended to form alloys which achieve any number of desired dynamic fatigue strength, stiffness or other properties for specific armature configurations.

Figure 2:
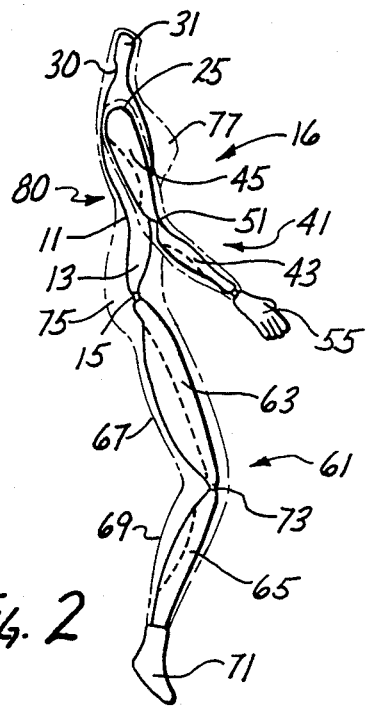
FIG. 2 is a side view of the armature of FIG. 1.

FIG. 2 sets forth a right side view of a posable figure generally referenced by numeral 16 constructed in accordance with the present invention. As described above, armature 10 includes a trunk support 11 having an upwardly extending neck support 30 and head support 31. Trunk support 11 of armature 10 further includes a hip 13. A right arm support 41 includes an upper arm support 45 coupled to trunk support 11 by a shoulder joint 25, a forearm support 43 coupled to upper arm support 45 by an elbow joint 51, and a right hand 55 coupled to forearm support 43 by a wrist 53. As is also described above, armature 10 includes a right leg support 61 having a thigh support 63 coupled to hip support 13 by hip joint 15, a shin support 65 coupled to thigh support 63 by a knee joint 73, and a right foot 71 coupled directly to shin support 65. It should be understood that left arm support 40 and left leg support 60 and their respective interconnecting joints are not seen in FIG. 2 due to being positioned directly behind right arm support 41 and right leg support 61 respectively.

In accordance with the invention, posable figure 16 further includes a molded skin 80 formed of a soft elastomeric material which may be either natural, or synthetic. thermoplastic or thermoset material. In addition, molded skin 80 may be formed of either foamed or solid material in accordance with the desired character of the molded skin. While any number of materials may be used to fabricate molded skin 80, materials such as vinyl, styrene ethylene butlyene styrene, styrene butadiene, or polyurethane have been successfully used.

In any event, molded skin 80 in the embodiment shown in FIG. 2 forms a generally soft textured flesh and skin combination which overlies and encloses all of armature 10 except for hands 54 and 55 and feet 70 and 71. But for these exceptions, molded skin 80 completely encloses armature 10 and is contoured to provide the appearance of a human female form (better seen in FIG. 3). Alternatively, the entire armature may be covered by the molded skin without departing from the spirit and scope of the present invention. While different methods of molding skin 80 about armature 10 may be used, the embodiment shown in FIGS. 2 and 8 is produced by insert molding armature 10 within molded skin 80 in accordance with the apparatus and method set forth in U.S. Pat. No. 4,470,784 issued to Piotrovsky which is signed to the assignee of the present application. In accordance with an important aspect of the present invention and as is set forth below in greater detail, molded skin 80 is continuous and encloses the various joints of armature 10 completely without the need of any additional or more complicated molding techniques. As a result of the one-piece construction of armature 10, molded skin 80 may be formed virtually in any configuration to complete the structure of figure 16 and provide the desired distribution of simulated flesh and skin upon armature 10. For example, the portion of molded skin 80 encasing right arm support 41 forms right arm 81 of figure 16. Similarly, the portion of molded skin 80 encasing thigh support 63 and shin support 65 forms thigh 67 and calf 69 respectively while the molded skin 80 encasement of trunk support 11 forms trunk 84, buttocks 75 and breasts 77 and 76. In addition and in accordance with an important aspect of the present invention, increased amounts of the material of molded skin 80 may be molded to the fleshier portions of posable figure 16 such as calf 69, thigh 67, buttocks 75, and breast 77 to more authentically replicate the characteristics of the human anatomy sought to be imitated by posable figure 16.

In its intended use, posable figure 16 may be posed in any number of desired positions by the movement of the articulated limbs due to the functioning of the integrally molded joints of armature 10. For example, right leg 91 may be moved about hip 85 by the flexing of hip joint 15 and calf 69 and right foot 71 may be moved with respect to thigh 67 by the movement of knee joint 73. In accordance with the invention, the material used in armature 10 is extremely elastic and therefore has little tendency to return to any previous position. In addition, the material used for molded skin 80 is similarly elastic and produces very little, if any, returning force upon armature 10 as the articulated limb portions are moved to pose figure 16.

Figure 3:
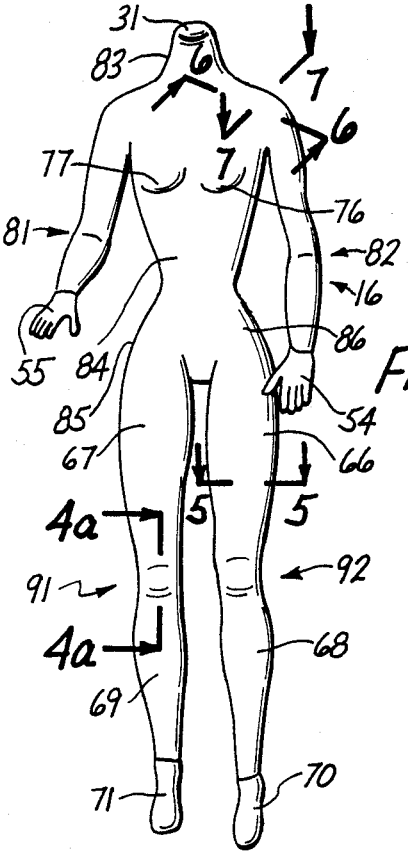
FIG. 3 is a front view of a posable figure having continuous skin constructed in accordance with the present invention.

FIG. 3 shows a front view of posable figure 16 in a typical pose. Molded skin 80 completely surrounds and encapsulates armature 10 (seen in FIG. 2) with the exception of hands 54 and 55 and feet 70 and 71. As described above, molded skin 80 is completely supported by armature !0 and is articulated through the plurality of joints and rigid members within armature 10 to form the figure shown in FIG. 3. As is also described above, molded skin 80 is distributed about armature 10 to replicate a female human form having the characteristic anatomy thereof. To provide realism of figure 16, molded skin 80 is configured to provide fleshy areas 68 and 69 to form the calf flesh portions of figure 16, thigh portions 66 and 67, as well as breast portions 76 and 77. Figure 16 further includes head support 31 which receives a separately molded head portion (not shown) which may be constructed in accordance with conventional molding techniques.

Figure 4A:
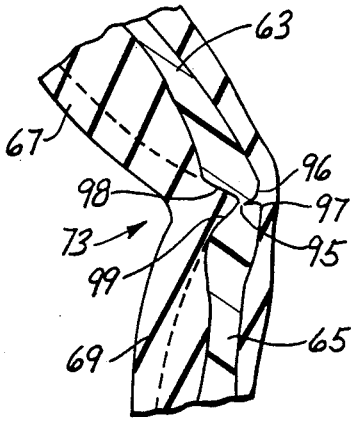
FIGS. 4A and 4B are partial section views of a portion of the present invention posable figure taken along section lines 4—4 in FIG. 3.
Figure 4B:
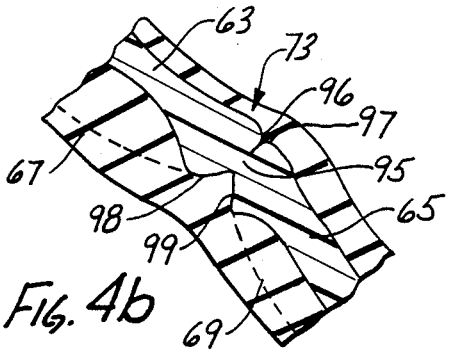

FIGS. 4A and 4B set forth section views of the knee joint portion of posable FIG. 16 taken along section lines 4—4 in FIG. 3. As described above, support 68 and shin support 65 are joined by knee joint 73. As is also described above, a portion of molded skin 80 surrounds thigh support 63 to form thigh 67 while a portion of molded skin 80 surrounds shin support 65 to form calf 69. As is also described above, molded skin 80 is continuous and surrounds knee joint 73 completely. Knee joint 73 includes a narrowed portion 95 formed by a pair of angled surfaces 98 and 99 on one side and a pair of outwardly extending edge portions 96 and 97. In accordance with the invention, the entire flexing of knee joint 75 occurring when calf 69 is moved with respect to thigh 67 takes place within narrowed portion 95 in a hinge-like motion which substantially replicates the motion of the human knee. In addition, with simultaneous reference to FIG. 1, it will be noted that knee 73 is narrowed solely in the direction transverse to thigh support 68 and shin support 65. Thus, while knee joint 73 is easily flexed in the motion directions shown in FIGS. 4A and 4B, very little flexing motion is permitted by knee joint 73 in any other direction. To further replicate the permitted motions of the human knee, the substantial separation between angled surfaces 98 and 99 permits calf 69 and thigh 67 to be further moved in the manner shown in FIG. 4A to smaller included angle characteristic of the permitted motion of the human knee joint. Conversely, edge portions 96 and 97 of knee joint 73 are brought into abutment as shown in FIG. 4B when calf 69 is moved with respect to thigh 67 to the straightened position shown in FIG. 4B. As will be apparent from examination of FIG. 4B, the relative angles between edges 96 and 97 is selected to produce abutment therebetween when thigh 67 and calf 69 ar brought into common alignment replicating a straight leg position. Thus, further movement beyond the straight leg position shown in FIG. 4B is inhibited by the closure and abutment of edges 96 and 97.

Figure 5:
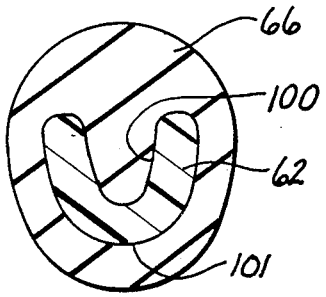
FIG. 5 is a section view of a portion of the present invention posable figure taken along section lines 5—5 in FIG. 3.

FIG. 5 sets forth a section view of thigh 66 taken along section lines 5—5 in FIG. 3. In accordance with an important aspect of the present invention, thigh support 62 defines a generally U-shaped cross section having an interior surface 100 and an exterior surface 101. In further accordance with the invention, thigh 66 is molded about thigh support 62 to completely encase thigh support 62 and be bonded to interior surface 100 and exterior surface 101. It should be noted that the U-shaped cross section of thigh support 62 provides increased surface area for a more reliable attachment between the material of thigh 66 and thigh support 62. In addition, the portion of thigh 66 molded within the interior portion of thigh support 62 provides increased strength of thigh 66 and causes the molded material of thigh 66 to resist rotation or twisting of the material of thigh 66 about thigh support 62. It will be apparent to those skilled in the art by examination of FIGS. 1 and 2 that the various limb portions of armature 10 are similarly configured to thigh support 62 and define generally U-shaped cross sections to produce the advantages shown in FIG. 5 for thigh portion 66.

Figure 6:
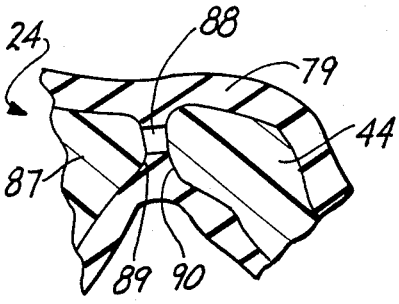
FIG. 6 is a partially sectioned front view of the shoulder joint portion of the present invention posable figure shown in FIG. 3.

FIG. 6 sets forth a section view of a shoulder joint 24 taken along section lines 6—6 in FIG. 8. Shoulder support 87 extends outwardly from trunk support 11 and defines an outer edge 89. A narrowed portion 88 integrally molded with shoulder support 87 extends outwardlY from edge 89 and is of substantially smaller cross section than shoulder support 87. Upper arm support 44, constructed in accordance with the foregoing descriptions, defines an inwardly facing edge 90 and is integrally molded with and joined to narrowed portion 88. In accordance with the invention, narrowed portion 88 is the sole attachment between upper arm support 44 and shoulder support 87. The length of narrowed portion 88 provides a predetermined spacing between edge 89 of shoulder support 87 and edge 90 of upper arm support 44. In further accordance with the invention, upper arm support 44 is movable with respect to shoulder support 87 in virtually all directions due to the flexing action of narrowed portion 88. The degree of motion permitted in shoulder joint 24 by the flexing of narrowed portion 88 is limited by the spacing between edges 89 and 90. In similar operation to that set forth below for knee joint 73 in FIGS. 4A and 4B, edges 89 and 90 are brought into abutment to define the extremes of motion of upper arm support 44 with respect to shoulder support 87. It will be apparent to those skilled in the art that the relative contours and spacings between edges 89 and 90 are selected to establish the degrees of permitted motion of upper arm support 44. Molded skin 80 is molded about shoulder joint 24 and completely encloses shoulder support 87, narrowed portion 88, and upper arm support 44 in the manner described below to complete the shoulder portion of the present invention posable figure.

Figure 7:
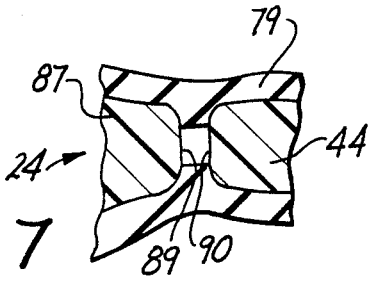
FIG. 7 is a partially sectioned top view of the shoulder joint portion of the present invention posable figure shown in FIG. 3.

FIG. 7 sets forth a section view of shoulder joint 24 taken along section lines 7—7 in FIG. 3. Shoulder support 87 extends outwardly from trunk support 11 (seen in FIG. 1) and terminates in an outwardly extending edge 89. Upper arm support 44 is coupled to shoulder support 87 by a narrowed portion 88 and defines an inwardly extending edge 90. Molded skin 80 encloses shoulder joint 24 to complete shoulder 79 in accordance with the foregoing descriptions. As can be seen by comparison of FIGS. 6 and 7, narrowed portion 88 is generally cylindrical in cross section to provide relatively uniform freedom of movement of upper arm portion 44. In addition, the spacing between edges 89 and 90 is generally uniform to provide freedom of movement of upper arm portion 44 in virtually any direction to closely approximate the permitted motions of the human arm with respect to the shoulder joint.

It will be apparent to those skilled in the art that, while knee joints 73 and shoulder joint 24 have been described in detail, the descriptions which are set forth apply equally well to knee joints 72 and shoulder joint 25. It will be further apparent to those skilled in the art that elbow joints 50 and 51 are constructed in a similar fashion to knee joints 72 and 73 and that hip joints 13 and 14 are constructed in similar fashion to shoulder joints 24 and 25.

What has been shown is a posable figure having a molded one-piece armature composed of a plurality of skeletal elements coupled by a plurality of integrally molded posable joint members. The one-piece armature is insert molded within a continuous flesh and skin outer covering to provide a posable figure having a continuous outer skin. The fabrication of the one-piece armature and the joints therein provides an improved posable figure having extended life and resistant to failure of the articulated joint members.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. A posable figure comprising:

a unitary nonmetallic molded armature formed to receive and securely attach to an outer skin and flesh covering having a body portion, a plurality of limb supports, and a plurality of interconnecting joints, said body portion, plurality of limb supports and interconnecting joints being formed of a single molded structure such that motion of said limb portions is limited to said joints; and a continuous molded skin and flesh covering encasing said body portion, said plurality of limb supports and said interconnecting joints and being bonded thereto.

2. A posable figure as set forth in claim 1 wherein said interconnecting joints each include a narrowed hinge portion and surrounding edge portions, said edge portions cooperating to limit joint motion.

3. A posable figure as set forth in claim 2 wherein said armature includes foot portions extending beyond said molded skin and flesh covering.

4. A posable figure as set forth in claim 3 wherein said armature includes hand portions extending beyond said molded skin and flesh covering.

5. A posable figure as set forth in claim 4 wherein said plurality of limb supports each define U-shaped cross sections.

6. A posable figure as set forth in claim 5 wherein said molded skin and flesh covering is formed of a foamed material and is distributed about said armature to provide relatively firm portions at some portions of said figure and relatively soft portions at other portions of said figure.

7. A posable figure as set forth in claim 6 wherein said armature is formed of a highly elastic thermoplastic material.

8. A posable figure as set forth in claim 6 wherein said armature is formed of a material selected from polybutylene terephthalate, polyethylene terephthalate, copolyester, and copolyester modified polyethylene terephthalate.

9. A human-like posable figure comprising:

a one-piece molded armature having a trunk portion, a pair of arm portions and a pair of leg portions arranged to resemble a human form;

a pair of shoulder joints defined in said armature coupling said pair of arm portions to said trunk portion;

a pair of hip joints defined in said armature coupling said pair of leg portions to said trunk portions; and a one-piece molded skin cover encasing said molded armature to replicate the skin and flesh portion of a human-like figure, said molded armature, said pair of shoulder joints and said pair of hip joints being formed of a single molded structure of nonmetallic material and being formed such that said molded skin covering readily bonds thereto.

10. A human-like posable figure as set forth in claim 9 wherein said arm portions each define upper arm and lower arm portions coupled by an integral elbow joint.

11. A human-like posable figure as set forth in claim 10 wherein said leg portions each define thigh and shin portions coupled by an integral knee joint.

12. A human-like posable figure as set forth in claim 11 wherein said shoulder, hip, knee and elbow joints are each formed of narrowed portions of said armature.

13. A human-like posable figure as set forth in claim 12 wherein said shoulder, hip, knee and elbow joints each include cooperating edge portions limiting joint motion.

14. A human-like posable figure as set forth in claim 13 wherein said molded skin is formed of a foam material and is distributed about said armature to provide a thicker covering at selected portions of said figure.

15. A human-like posable figure as set forth in claim 14 wherein said armature defines a plurality of apertures therethrough to receive said molded skin and strengthen the bond between said armature and said molded skin.

* * * * *